United States Patent [19]

Angele et al.

[11] Patent Number: 4,461,229

[45] Date of Patent: Jul. 24, 1984

[54] DEVICE FOR PULLING OUT AND CUTTING OFF THREADS IN A SEWING MACHINE

[75] Inventors: Eugen Angele; Ludwig Drechsel, both of Kaiserslautern, Fed. Rep. of Germany

[73] Assignee: Pfaff Industriemaschinen GmbH, Fed. Rep. of Germany

[21] Appl. No.: 359,068

[22] Filed: Mar. 17, 1982

[30] Foreign Application Priority Data

Apr. 29, 1981 [DE] Fed. Rep. of Germany ..... 3116931

[51] Int. Cl.[3] ..... D05B 27/14; D05B 65/02

[52] U.S. Cl. ..... 112/291; 112/295; 112/297; 112/301; 112/255; 112/318; 112/319

[58] Field of Search ..... 112/255, 288, 291, 293, 112/295, 296, 298, 301, 318, 319, 322, 297

[56] References Cited

U.S. PATENT DOCUMENTS

| | | | |
|---|---|---|---|
| 1,401,465 | 12/1921 | De Voe | 112/298 |
| 2,153,244 | 4/1939 | Galkin | 112/322 X |
| 2,730,977 | 1/1956 | Hayes et al. | 112/322 |
| 2,850,997 | 9/1958 | Rosenbloom | 112/288 |
| 2,858,786 | 11/1958 | Benink et al. | 112/298 X |
| 3,532,065 | 10/1970 | Marforio | 112/301 X |
| 3,726,240 | 4/1973 | Emich | 112/322 X |

FOREIGN PATENT DOCUMENTS

| | | | |
|---|---|---|---|
| 488494 | 5/1976 | Australia | 112/295 |
| 58652 | 9/1891 | Fed. Rep. of Germany . | |
| 2347305 | 3/1974 | Fed. Rep. of Germany | 112/293 |

OTHER PUBLICATIONS

Pfaff 3819—Integrated Sewing Unit for Making Jeans Waistbands, (12 page booklet), 1981.

*Primary Examiner*—Wm. Carter Reynolds
*Attorney, Agent, or Firm*—McGlew and Tuttle

[57] ABSTRACT

A device is disclosed for pulling out and cutting off the needle and looper threads in a sewing machine with a delivery roller for delivering material to the machine sewing station. The delivery roller is driven over a first drive, which is dependent on the sewing machine main drive and over a second drive, which is independent of the sewing machine main drive. On the looper of the sewing machine is secured a cutting blade for the needle thread. Furthermore, a needle thread clamp is provided. In order to manage, with a single means for pulling out the needle and looper threads by different lengths, a cutting device for the looper thread is arranged between the cutting blade and the delivery roller, with a guide which is traversed by a thread inlet groove and with a counterknife for a thread severing knife that moves transverse to the material feeding direction. The delivery roller is driven over the second drive for pulling out the threads. The pull out length of the needle thread is determined by controlling the cutting time, which depends on the closing time of the needle thread clamp.

6 Claims, 5 Drawing Figures

V
III
III

DEVICE FOR PULLING OUT AND CUTTING OFF THREADS IN A SEWING MACHINE

FIELD AND BACKGROUND OF THE INVENTION

The present invention relates in general to sewing machines and in particular to a new and useful device for pulling out and cutting off the needle and looper thread of a sewing machine, wherein the needle and looper threads are first pulled out by unequal amounts and thereafter cut off.

In a sewing machine for waistband finishing it is already known (Pfaff booklet 381900) to start with the sewing at a certain distance from the head of the waistband and to finish the sewing substantially at the same distance before reaching the end of the waistband. During the sewing operation, the sewing material is fed in a feeding direction over a first delivery roller which is driven by a drive that depends from the machine main shaft. A second drive is provided for the delivery roller which operates independently of the first drive, by which the sewing material is displaced in the sewing intervals by the length of the seam-free zones. On each looper is secured a severing knife, against the cutting edge of which the leg of the needle thread leading to the sewing material is moved about the seam-free zone at the end of the trailing portion of the waistband during the displacement of the sewing material, with the sewing machine standing still. A cutoff device for the looper threads is not provided in this sewing machine. The looper threads must therefore be cut off by hand. To this end the sewing material must be removed by hand in the feeding direction with the pressure foot lifted and the delivery roller raised. This procedure not only delays a new start, but it also causes unnecessary thread consumption.

For the safe formation of the next stitch, after the thread has been cut off, the needle and looper thread must be pulled out by different lengths and only then cut off. If a single cutoff device is provided for needle and looper thread, as for example, in a device according to U.S. Pat. No. 3,345,963, this requirement for thread cutting cannot be met, or the needle and the looper thread must be pulled out with different lengths by a specially designed and fitted guide or by deflecting surfaces (Swiss Pat. No. 416,285).

Another solution consists in providing separate thread pull-out means for needle and looper threads, which would have to perform, however, pull-out movements of different lengths and would have to be accommodated together with their driving means in the space below the needle plate or above the work support plate in the delivery path of the sewing material. Both are impossible, however.

SUMMARY OF THE INVENTION

The object of the present invention is to provide a device for pulling out and cutting off the needle and looper threads, which uses only a single pull-out means and permits the pulling out and cutting off of needle and looper threads of different lengths.

Accordingly another object of the invention is to provide a device for pulling out and cutting off a needle thread and a looper thread of a sewing machine having a main drive, a looper and a needle plate, comprising, a material delivery roller for feeding material in a feed direction, first drive means connected between the main drive and the roller for rotating the roller to feed material for sewing during the operation of the main drive, second drive means connected to the roller and independent of the main drive for rotating the roller, a first cutting blade connected to the looper for cutting the needle thread with rotation of the roller by said second drive means and clamping of the needle thread, clamping means connected to the sewing machine for clamping the needle thread, a guide connected above the needle plate and between the first cutting blade and the roller and extending transversely to the feed direction, the guide including an inlet groove for the passage of the looper thread, a second cutting blade movable in the guide and past the groove to cut the looper thread, the guide including a counter blade for said second cutting blade, and cutting blade drive means for driving said second cutting blade, said second drive means operable to move the material and pull out the needle and looper threads by selected amounts before the needle thread is clamped by said clamping means and cut by said first cutting blade and the cutting blade drive means is operable to move the second cutting blade to cut the looper thread.

Due to the series arrangement of the cut off devices for the needle and looper thread, it suffices to operate the delivery roll in a single continuous switching stroke, with the sewing machine stopped, in order to pull out the needle thread and to move it toward the cutting blade secured on the looper in order to cut the needle thread off, and to pull the looper thread into the inlet groove traversing the guide for the looper thread severing knife, where it is cut off by the looper thread severing knife at the end of the switching stroke of the delivery roller. The thread ends lie on the top side of the needle plate after they have been cut off. They can thus be retained by the presser foot, so that separate clamps for the thread ends are not necessary. After the thread has been cut off, the next sewing operation can be started without delay. There is no thread loss, nor are the threads connecting two successive work pieces squeezed off by the delivery roller.

In the design of the inventive device, where provided for use in a multiple needle sewing machine, where each looper carries a cutting blade for the needle thread, the cutting point for the looper threads can be fixed exactly by providing a separate inlet groove for each looper thread in the guide for the severing knife.

The pull out length of the needle threads can be varied in a simple manner by determining the cutoff time for the needle threads by controlling the closing time for the thread clamp during the takeoff movement of the thread.

A further object of the invention is to provide such a device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
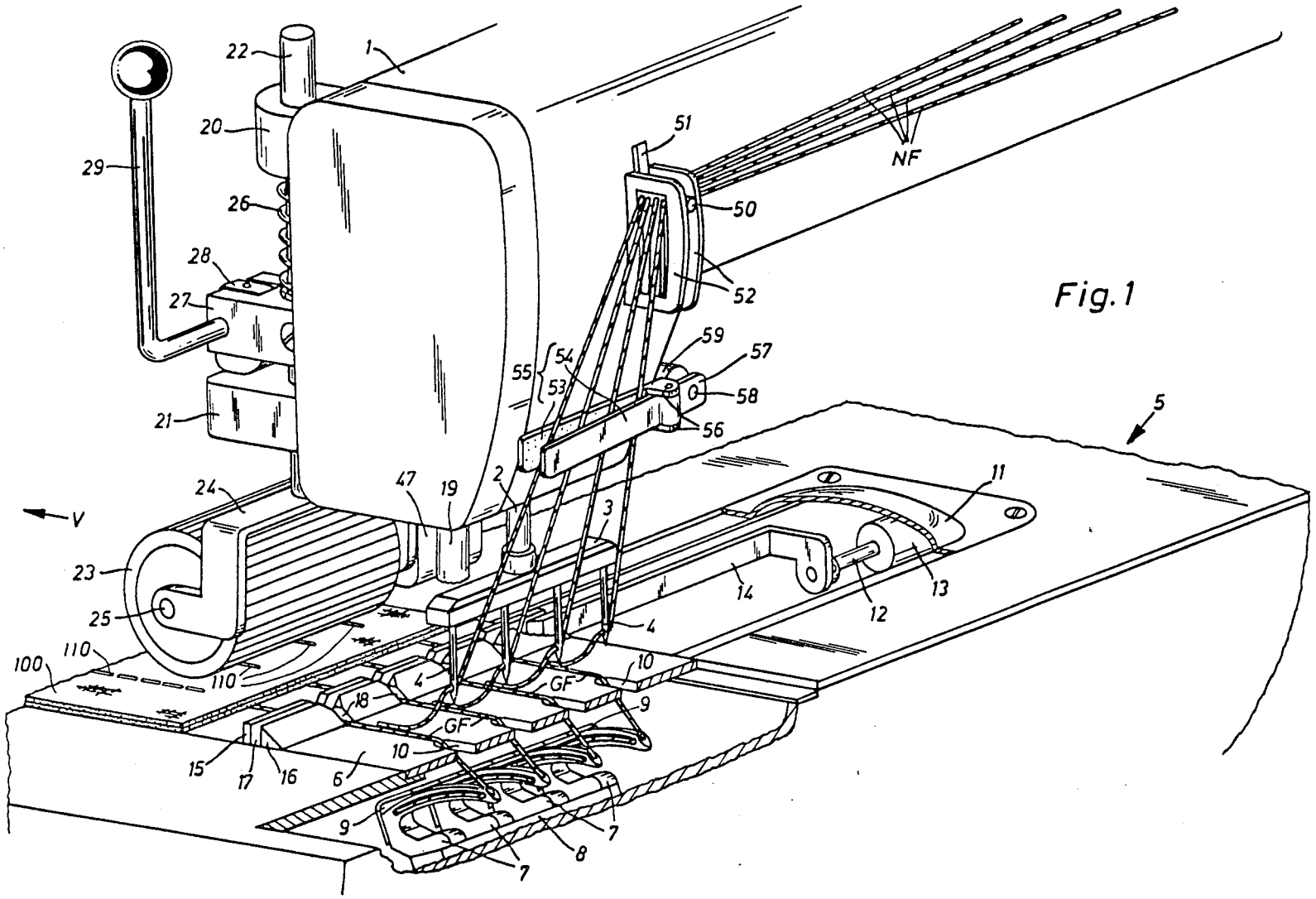
FIG. 1 is a perspective partial view of a four needle chain stitch sewing machine according to the invention, at the end of a sewing operation with a delivery roller lifted from the sewing machine.

Referring to the drawings in particular, the invention embodied therein, in FIG. 1, comprises a device for pulling out and cutting off a needle and a looper thread used in a sewing machine having a head 1 and a support arm 5.

The sewing machine is driven in known fashion by a stop motor and can be provided with a device for stopping it at a certain position, e.g. in the needle-up position.

In head 1 of the sewing machine is mounted an ascending and descending needle bar 2, which carries at its bottom end a needle holder 3 in which four thread carrying needles 4 are secured. A thread carrying double chain stitch looper 7 arranged in the work support arm 5 under needle plate 6 cooperates with each needle bar 4 for the formation of four parallel seams 110 of stitch type 401. Loopers 7 are secured in an oscillating loop carrier 8 and are replaceable. On each looper 7 is secured a cutting blade 9 for severing the leg of the loops of the needle threads NF leading to the sewing material which is taken up by the looper. For the passage of needle 4, oblong slots 10 are provided in needle plate 6, which are so dimensioned that the threads do not come in contact with the cutting edge of blades 9 during sewing, but only at the end of the sewing operation when the sewing material is removed.

Under a cover plate 11 of work support arm 5 is arranged, at a distance behind needles 4, a severing knife 14 for the looper threads GF connected with the piston rod 12 of a single-action compressed air cylinder 13, which knife can be displaced transverse to the feeding direction (arrow V) in a guide 17 formed by two plates 15,16 arranged on needle plate 6. Guide plate 16 rises obliquely in the feeding direction so as not to hinder the sewing material in its sliding movement. A separate inlet groove 18 is provided for each looper thread GF, transversing guide plates 15,16 in the feeding direction. The usual presser foot secured on the presser foot bar 19 has been omitted for clarity.

In the back of head 1 are provided two bearing plates 20,21 for supporting bar 22 of a delivery roller 23, which is rotatable in a stirrup 24 secured at the bottom end of supporting bar 22 with shaft 25 mounted therein. Supporting bar 22 is pressed down by a compression spring 26 arranged thereon, which bears with one end on bearing plate 20 and with its other end of a forked piece 27 secured on supporting bar 22. A cam 28 is mounted in forked piece 27 for raising and lowering supporting bar 22 with delivery roller 23. Cam 28 bears on plate 21, and can be actuated by a hand lever 29.

Figures 2, 3:
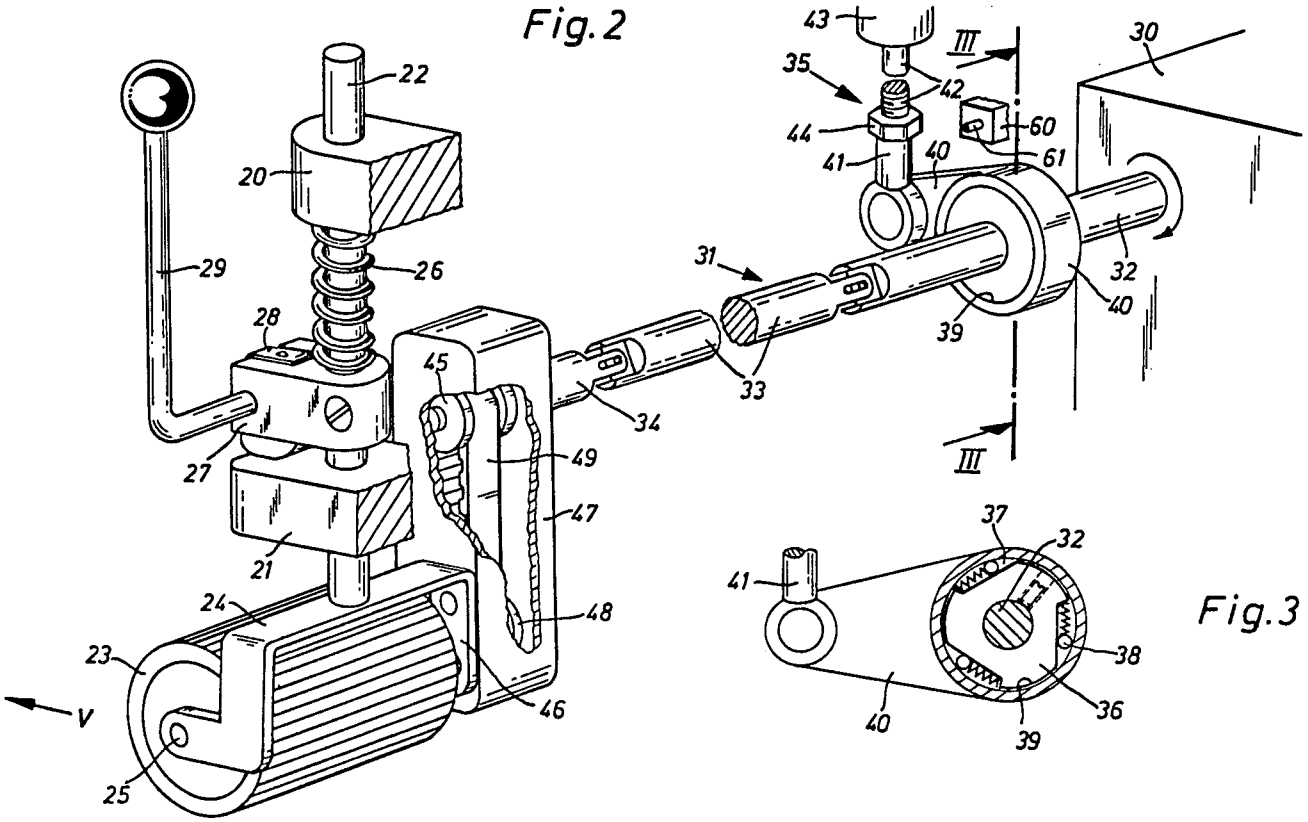
FIG. 2 is a perspective view of the driving means for the delivery roller of the invention.
FIG. 3 is a sectional view taken along line III—III of FIG. 2.

A first drive 30 (see FIG. 5) is provided for driving delivery roller 23 during the sewing operation and is provided with an overrunning clutch which depends on the main shaft 75 of the sewing machine and which is connected to rotate a cardan shaft 31, which consists of shaft parts 32,33 and 34, while a second drive 35 which is independent of the sewing machine and which likewise has an overrunning clutch, is provided for driving delivery roller 23, with the machine stopped. The second drive 35 comprises an inner clutch part 36, which is secured on part 32 of cardan shaft 31 and which has three recesses 37 for receiving spring loaded roll bodies 38. The inner clutch part 36 is arranged in bore 39 of an outer clutch part 40 to the free end of which a ball-and-socket joint 41 is connected, which is arranged at the free end of piston rod 42 of a compressed air cylinder 43 performing a working stroke against the action of a restoring spring arranged in the cylinder housing, and is clamped by a nut 44. The arrangement of recesses 37 is such that, when the outer clutch part 40 is turned clockwise, as seen in FIG. 3, a clamping connection is established between the inner and outer clutch part 36 and 40, so that cardan shaft 31 is rotated clockwise, while the clamping connection is interrupted when the outer clutch part 40 is turned counterclockwise. Cardan shaft 31 can therefore pass through freely when it is driven clockwise by the first drive 30.

The free end of shaft portion 34 on which is secured a toothed belt wheel 45, protrudes into the interior of a gear box 47 secured on one leg 46 of stirrup 24. Into the interior of gear box 47 also protrudes one end of shaft 25 on which is secured a toothed belt wheel 48. The rotary movement of cardan shaft 31 is transmitted by a toothed belt 49 placed around toothed belt wheels 45 and 48 to shaft 25, and thus to delivery roller 23 to advance the sewing material in the feeding direction (arrow V).

A thread takeup 50 which is connected to needle bar 2 is provided for controlling needle threads NF. Takeup 50 is led through a slot 51 in the machine casing to the outside thereof and can be moved between two hoop guards 52. Furthermore, a needle thread clamp 55 is provided which consists of a one-armed fixed part 53 and of a two-armed movable part 54, provided at the front end of head 1. The fixed part 53 is secured on the machine casing. It has two angularly bent plates 56, between which movable part 54 is pivotally mounted. Piston rod 58 of a compressed air cylinder 59 arranged on the machine casing, is connected with arm 57 of part 54. A switch 60 is provided for controlling the compressed air supply to compressed air cylinder 59, whose tripping pin 61 is arranged in the turning range of the outer clutch part 40.

The mode of operation is as follows:

The sewing material 100, inserted under the presser foot (not shown) and delivery roller 23, e.g. a waistband to be sewn on the upper edge of a pair of trousers, is driven constantly or in steps by the first drive 30 which rotates in dependence on the main shaft of the sewing machine 1, over cardan shaft 31 and toothed belt 49 placed over toothed belt wheels 45 and 48 for the progressive formation of a seam in the feeding direction (arrow V). Overrunning clutch 36 to 38 is overtaken and not engaged. At the end of the seam, the sewing machine is stopped with the needles in their up position. Loopers 7 have entered the needle thread loops, however. For pulling out the threads with a length sufficient for the following first stitch formation of a new sewing operation, compressed air cylinder 43 is supplied with compressed air. Its piston rod 42 tightens against the action of its restoring spring and turns the outer clutch part 40 of the second drive 35 clockwise, as seen in FIG. 3. The roll bodies 38 arrive in their clamping position and drive, over the inner clutch part 36, the cardan shaft 31, and thus over toothed belt 49 placed over toothed belt wheels 45 and 48, the delivery roller 23, displacing the sewing material 100 by a certain angular amount. At a time selected corresponding to the length of the thread to be pulled during this partial revolution of delivery roller 23, which is independent of the sewing machine drive, for example, by switch 60, whose tripping pin 61 is arranged in the turning range of the outer clutch part 40, compressed air cylinder 59 is supplied with compressed air, whose piston rod 58 actuates the moving part 54 of needle thread clamp 55 against the action of a restoring spring, thus closing needle thread clamp 55 and clamping the needle threads NF. The needle threads NF are consequently tensioned during the further movement of the sewing material and are cut off at cutting blades 9 and at the thread portion leading to the sewing material 100. That is, before clamp 55 is activated, the needle thread slides through the looper and out of opening 10. When clamp 55 is activated, the needle thread is pulled across blade 9 and cut. After compressed air cylinder 59 has been evacuated, thread clamp 55 is opened again by the restoring spring arranged in the cylinder housing.

In the further course of the partial rotation of shaft 34, the looper threads GF are deflected into inlet grooves 18 and pulled out to the length necessary for the following first stitch formation, which is greater for technical reasons than the length of needle threads NF. By adjusting the position of switch 60 and varying the effective working stroke of piston rod 42 it is possible to vary the pulled out length of the needle and looper threads as will be described more fully hereinunder.

At the end of the partial rotation of delivery roller 23, compressed air cylinder 43 is evacuated, its piston rod 42, and thus the outer clutch part 40 are returned to their starting position by the restoring spring arranged in the cylinder housing. Compressed air cylinder 13 is then supplied with compressed air so that its piston rod 12 displaces severing knife 14 against the action of a restoring spring, in guide 17 transverse to the feeding direction of arrow V, whereby the looper threads GF are severed. Guide plate 15 traversed by inlet grooves 18 serves as a counterknife for severing knife 14. When compressed air cylinder 13 is evacuated, severing knife 14 is moved back into starting position by the restoring spring arranged in the cylinder housing. By again actuating delivery roller 23 from drive 35, it is also possible to move the sewing material further, after the threads have been cut off, e.g. to a path guide arranged behind delivery roller 23.

The ends of the needle and looper threads lie on the top side of needle plate 6 after they have been cut off. They are clamped by the presser foot after a new workpiece has been inserted, so that additional clamps for the individual thread ends are not necessary.

Figure 4:
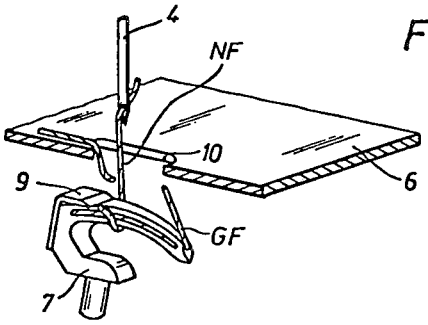
FIG. 4 is a fragmentary perspective view of one needle and looper showing a needle thread loop about the looper and the needle thread being cut.

FIG. 4 shows a needle thread loop NF engaged on looper 7 just as it is being cut by blade 9.

Figure 5:
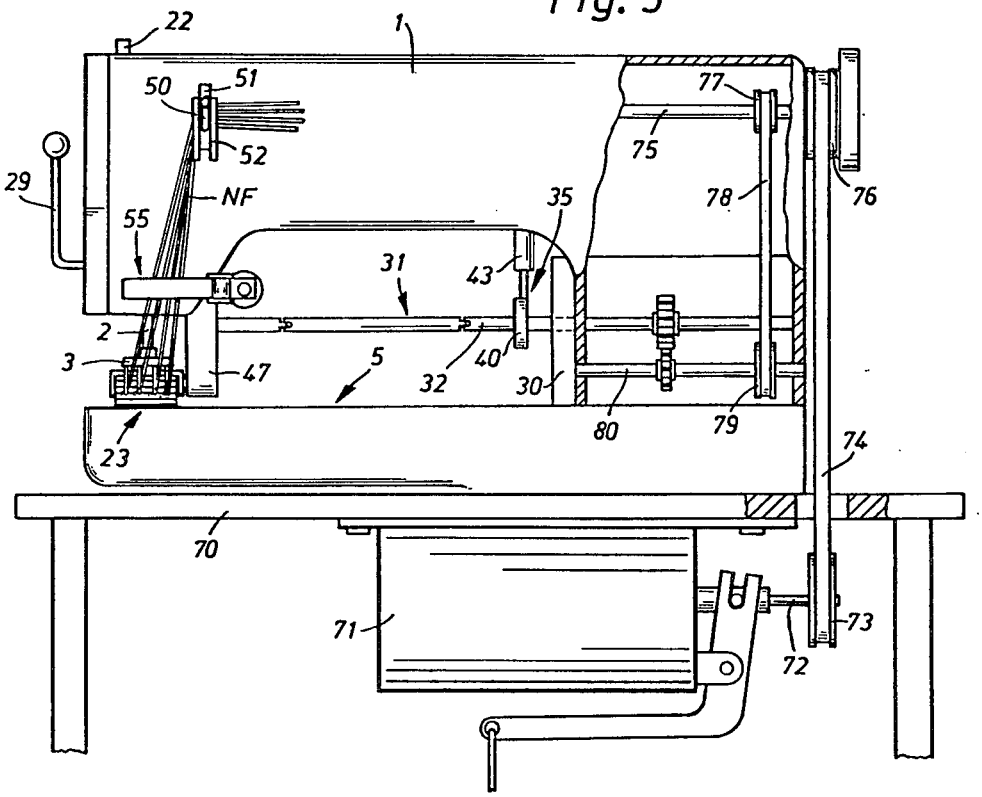
FIG. 5 is a side elevational view of the machine in FIG. 1.

FIG. 5 shows the main drive means which is of standard design and includes a motor 71 mounted under sewing machine table 70 having a shaft 72 and pulley 73 for driving a belt 74 which in turn drives pulley 76 and shaft 75. Pulley 77 on shaft 75 is connected over belt 78 and pulley 79 to shaft 80 rotatable in first drive 30. Cardan shaft 31 is driven by shaft 80 over gears shown in FIG. 5.

While a specific embodiment of the invention has been shown and described in detail to illustrate the application of the principles of the invention, it will be understood that the invention may be embodied otherwise without departing from such principles.

What is claimed is:

1. A device for pulling out and cutting off a needle thread and a looper thread of a sewing machine having a main drive, a looper and a needle plate, comprising:

a material delivery roller for feeding material in a feed direction;

first drive means connected to said roller and to said main drive for rotating said roller with operation of said main drive;

second drive means connected to said roller and independent of said main drive for rotating said roller to advance the material in said feed direction;

a first cutting blade connected to the looper for cutting the needle thread with rotation of said roller by said second drive means and clamping of the needle thread;

clamping means connected to the sewing machine for clamping the needle thread;

a guide connected above the needle plate and between said first cutting blade and said roller and extending transversely to the feed direction;

said guide including an inlet groove for the passage of the looper thread;

a second cutting blade movable in said guide past said groove to cut the looper thread;

said guide having a counterknife for cooperation with said second cutting blade to cut the looper thread; and cutting blade drive means connected to said second cutting blade for moving said second cutting blade to cut the looper thread after said second drive means is operable to rotate said roller and advance the material in the feed direction by a selected amount.

2. A device according to claim 1, including means for activating said clamping means at a selected time after the activation of said second drive means to rotate said roller, said selected time corresponding to an amount of needle thread pulled out by said roller before the needle thread is cut by said first cutting blade.

3. A device according to claim 1, including an overriding clutch connected between said first and second drive means.

4. A device according to claim 3, wherein said first and second drive means include a common shaft extending from the sewing machine main drive, said clutch comprises a first clutch part connected to said common shaft and a second clutch part forming a part of said second drive means, a lever arm extending from said second clutch part and an actuator connected to said lever arm.

5. A device according to claim 4, including a switch having a tripping pin extending in the path of travel of said lever arm, said switch connected to said clamp means for activating said clamp means with a predetermined rotation of said lever arm to activate said clamp and thereby cut the needle thread after a selected time, movement of said lever arm causing rotation of said common shaft and said roller for advancing the material in said feed direction.

6. A device according to claim 1, wherein the sewing machine includes a plurality of needles each with a separate needle thread and a plurality of loopers, in addition to the mentioned looper, each with a separate looper thread, each additional looper including an additional first cutting blade, said guide including a separate inlet groove for each additional looper thread, said second cutting blade movable by said cutting blade drive means through said guide and past each of said grooves to cut each looper thread in each guide.

* * * * *